United States Patent [19]

Grosse

[11] 4,040,216

[45] Aug. 9, 1977

[54] PILLARS, WALLS AND BUILDINGS

[75] Inventor: Aristid V. Grosse, Haverford, Pa.

[73] Assignee: A & T Development Corporation, Philadelphia, Pa.

[21] Appl. No.: 578,931

[22] Filed: May 19, 1975

[51] Int. Cl.[2] ..... E04B 1/00; E02D 27/00

[52] U.S. Cl. ..... 52/169.13; 52/224; 52/263; 61/35; 61/81; 52/63

[58] Field of Search ..... 52/22, 90, 222, 224, 52/263, 727, 731, 743, 169; 61/11, 35, 39, 40, 50, 51, 53, 81, 52; 135/1

[56] References Cited

U.S. PATENT DOCUMENTS

| | | | |
|---|---|---|---|
| 81,532 | 8/1868 | Perry | 61/40 |
| 941,087 | 11/1909 | Moore | 61/40 |
| 1,161,512 | 11/1915 | Nitsche | 61/40 |
| 3,357,193 | 12/1967 | Fitzgibbon | 61/35 |
| 3,382,627 | 5/1968 | Vartia | 52/745 X |
| 3,421,326 | 1/1969 | Vidal | 61/35 X |
| 3,492,826 | 2/1970 | Horstketter et al. | 52/169 |
| 3,503,172 | 3/1970 | Beguin | 52/222 X |
| 3,667,175 | 6/1972 | Bjorksten | 52/309 |
| 3,793,794 | 2/1974 | Archer et al. | 52/725 X |
| 3,859,798 | 1/1975 | Terashima | 61/35 X |

*Primary Examiner*—J. Karl Bell

*Attorney, Agent, or Firm*—Littlepage, Quaintance, Murphy, Richardson & Webner

[57] ABSTRACT

A structural member comprises a soil-retaining sheet having two antipodal edges, means for joining the two antipodal edges when proximately positioned to maintain the sheet in a tubular configuration, and a column of soil retained within the tubular configuration of the sheet. One or more of the structural members when positioned substantially upright can be used to form a pillar. A plurality of horizontally-adjacent pillars can be used to form a wall which together with other walls can be used to form a building particularly adapted to desert location.

10 Claims, 9 Drawing Figures

FIG. 3
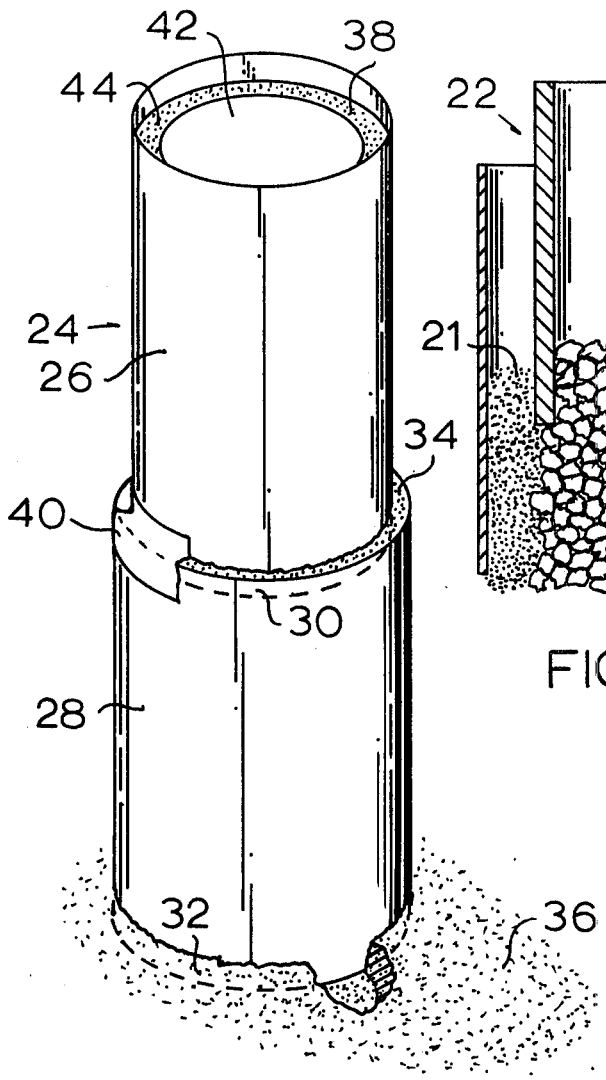
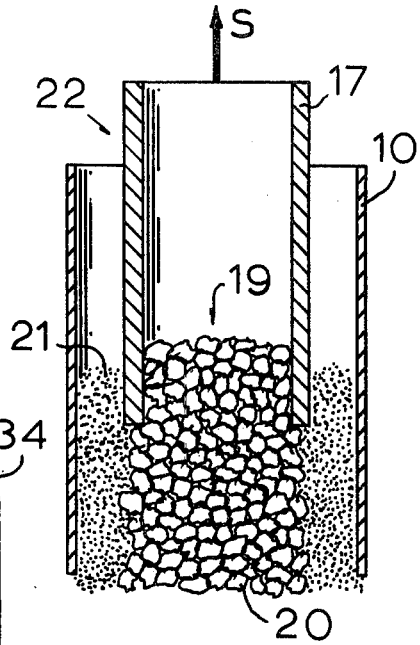
FIG. 9
FIG. 1
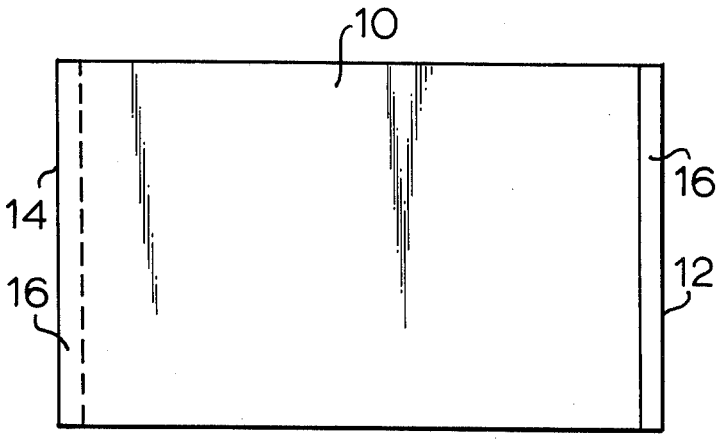
FIG. 2
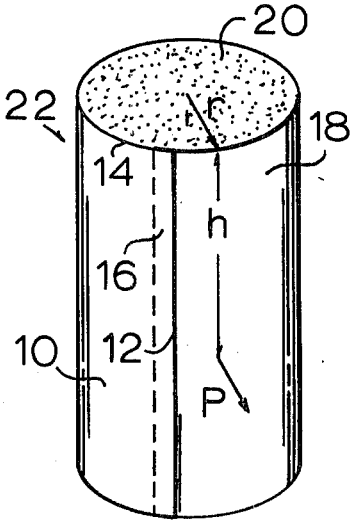

PILLARS, WALLS AND BUILDINGS

BACKGROUND OF THE INVENTION

1. Field of the Invention

This invention relates to building members and more particularly to building members constructed to provide a load bearing column, wall, or the like. This invention has particular utility in dry, sandy regions such as deserts.

2. Description of the Prior Art

Various types of vertically oriented columns are known to the building art which are dimensioned to support a load. In general, the columns are fabricated from materials which have inherent structural integrity such as steel or other metals. Columns may also be fabricated from particulate material such as sand, gravel, or other aggregate bonded together by a binder such as conventional cement, water, and lime. In order to fabricate structures utilizing structural members of this type, particularly in remote desert areas, it is necessary to transport the heavy, often bulky, and cumbersome materials such as steel, cement or other binder, and even water to the building site.

Accordingly, it is an object of the invention to provide a new building means utilizing soil from the immediate vicinity of the building site and a minimum of other materials requiring transportation.

It is another object of the invention to provide load supporting structural members composed of soil or particulate aggregate material without the use of any binder bonding the particulate material together.

SUMMARY OF THE INVENTION

A unique feature of this invention is the use of a soil-retaining sheet in a tubular configuration to retain a column of soil and thereby form a load bearing structural member. An advantage of such a structural member is to be found in the low transportation cost required in the transportation of the soil-retaining sheet.

Another feature of the invention is the use of a plurality of soil-retaining sheets in the form of a tube positioned substantially upright, each tube extending downward into the soil immediately surrounding the lower end of the tube, to form a pillar. One advantage of a pillar formed in this manner is the absence of any mating element between the tubes comprising the pillar other than the soil retained within each tube and the proximate location of the tubes with respect to each other.

Still another feature of the invention is a wall comprising a plurality of horizontally-adjacent pillars according to this invention. An advantage of a wall constructed in this manner is to be found in the strength, integrity, and insulating character of the wall when formed with the pillars abuting one another. Still another advantage of a wall formed according to this invention is to be found in the variable nature of the wall when each pillar is spaced from adjacent pillars in the wall and joined to each other by a substantially linear sheet fixed tangentially to the pillars.

Yet another feature of this invention is a desert building comprising a plurality of walls one or more of which consists of a plurality of horizontally-adjacent pillars according to this invention. A distinct advantage is to be found in the minimum amount of materials and skill of workmanship needed to construct such a building.

A basic feature of this invention is the use of columns of soil as structural members, the soil being retained in a cylindrical configuration by a soil-retaining sheet. Since no binder is added to the soil forming the column, it is the tensile strength of the soil-retaining sheet, as well as the behavior of particulate soils under compression which largely determines the engineering parameters. Basically, a column of particulate soil does not exhibit hydraulic behavior. That is, in conrast to liquids where the hydraulic pressure is proportional to the height of the liquid, with particulate pourable solids, the relation between pressure and height is non-linear. Generally, for a cylindrical column, after the height of the cylinder is between 3 and 4 times the diameter of the cylinder, the pressure increases negligibly with increasing height of the cylinder. This is reflected by the well-known Janssen equation:

$$\text{I. } P = (\rho r/2a)\,(1 - e^{2Kah/r})$$

The importance of this relation will become apparent from our subsequent discussion in connection with FIG. 2.

Various other objects, advantages and features of the invention will become apparent to those skilled in the art from the following description, taken in connection with the accompanying drawings.

BRIEf DESCRIPTION OF THE DRAWINGS

FIG. 1 is a plan view of a soil-retaining sheet according to this invention having means for joining to antipodal edges of the sheet when proximately positioned to maintain the sheet in a tubular configuration.

FIG. 2 is a perspective view of a structural member according to this invention comprising the soil-retaining sheet of FIG. 1 in a tubular configuration and a column of soil retained within the tubular configuration of the sheet.

FIG. 3 is a perspective view of a pillar according to this invention comprising a plurality of tubes positioned substantially upright, each tube having a minor portion extending downward into the soil immediately surrounding the lower end of the tube.

FIG. 9 is a diagram of an inverse slip-forming technique for forming a pillar according to this invention.

DESCRIPTION OF PREFERRED EMBODIMENTS

Figure 4:
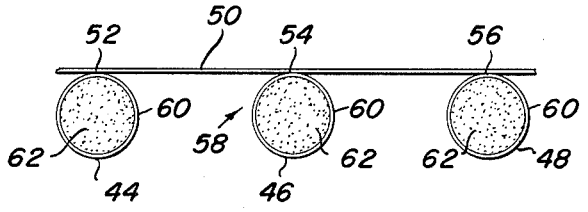
FIG. 4 is a plan view of a wall comprising a plurality of horizontally-adjacent pillars according to this invention having a substantially linear sheet fixed tangentially to the plurality of horizontally-adjacent pillars.

In FIG. 1 a soil-retaining sheet 10 according to this invention has two antipodal edges 12 and 14. The sheet 10 may be made of any material which has sufficient tensile strength to perform the intended function, namely, to retain a column of soil in a pillar-like configuration. While fiber-reinforced synthetic resins, and foils of steel, stainless steel, galvanized metal, or brass may be used, an aluminum foil is the preferred material due to its high tensile strength, resistance to weathering by the presence of an oxide coating, low density favorably affecting the transportation cost, and low initial cost.

The material comprising the sheet desirably has the highest tensile strength per unit cost. Here the common metals like aluminum and steel far exceed the common plastics like polyethylene. In the following table, typical values of Young's modulus of elasticity is given for selected maaterials.

TABLE I

| | |
|---|---|
| Aluminum | $10 \times 10^6$ |
| Brass | $13 \times 10^6$ |
| Steel | $28 \times 10^6$ |
| Polyethylene | $20 \times 10^3$ |
| Rubber | $8 \times 10^3$ |

Along the antipodal edges is means 16 for joining the two antipodal edges 12 and 14 when approximately positioned to maintain the sheet 10 in a tubular configuration such as is shown in FIG. 2. The joining means 16 can be any means capable of forming a continuous weld between the two antipodal edges 112 and 14 of sheet 10. Preferably the joining means 16 is an adhesive of the room temperature curing epoxy type. While the sheet 10 is shown in FIG. 1 to be rectangular, in certain circumstances a sheet having a parallelogram or trapezoidal shape may be preferred.

When the two antipodal edges 12 and 14 of sheet 10 are joined by the joining means 16, the sheet 10 is maintained in a tubular configuration as shown in FIG. 2. The tube 18 is then filled with soil 20 indigenous to the surrounding. A soil such as sand which is easily poured and packed into a given volume is preferred over a lumpy soil such as wet clay or crushed rock. The column of soil 20 contains no cement or adhesive since the soil is retained in its column or pillar-like configuration solely by the presesnce of the soil-retaining sheet 10.

The structural member 22 thus formed comprises a soil-retaining sheet 10 having two antipoidal edges 12 amd 14, means 16 for joining the two antipodal edges 12 and 14, when approximately positioned to maintain the sheet 10 in a tubular configuration 18 of radius $r$, and a column of soil 20 retained within the tubular configuration 18 of the sheet 10. The radially directed pressure P measured at a distance h from the top of the column of soil 20 is given by the Janssen equation:

$$\text{I. } P = (\rho r/2\alpha)(1 - e^{2Kah/r})$$

where $\rho$ equals the density of the soil; $\alpha$ is the coefficient of friction between the particular soil and the material used to form the soil-retaining sheet 10; $r$ is the radius of the column of soil; and $k$ is an empirically-determined constant equal to the ratio of the lateral force to the vertical force at any point within the column soil. Soil such as sand will have a value of $k$ between 0.5 and 0.7. The value of $\alpha$ for sand on aluminum is approximately 0.6. Further discussion of the Janssen relation can be found in W.L. McCabe et al, *Unit Operations of Chemical Engineering,* p. 246–248, McGraw-Hill, 1956.

The thickness of the material forming the soil-retaining sheet 10 is then dependent upon the maximum pressure expected to be experienced derived from the Janssen relation, the circumference C of the column of soil, and the strength S of the particular material selected to form the soil-retaining sheet 10. The minimum thickness T is then found from:

$$T = PC/S.\ 2\pi$$

Thus, as an example, a 1 mil aluminum sheet, did hold a sand pillar 2 feet in diameter and 4 feet high. A 5 mil sheet of aluminum did support a column of the same sand 6 feet in diameter and 8 feet high. Wet sand, as in a desert greenhouse, is held eacier than dry sand, although the density of the mixture is higher.

Since the most desirable features of the column of soil 20 and the soil-retaining sheet 10 come from the even distribution of pressure on the soil-retaining sheet, it is necessary that where gravel or crushed rock is to be used to form the column of soil, a layer of finely-divided material such as sand is placed immediately adjacent to the soil-retaining sheet to act as a forced distributing buffer. This can most easily be achieved by using an inverted slip-forming technique diagrammatically ilustrated in FIG. 9 where a column of soil 20 comprised of a lumpy or rocky component 19 and a more finely-divided component 21 is placed within a soil-retaining sheet 10. A tubular element 17 is coaxially positioned within the tubular soil-retaining sheet 10. The finely-divided component 21 is placed between the tubular component 17 and the soil-retaining sheet 10 while the more coarsely-divided component 19 is placed within the tubular element 17. Periodically, the tubular element 17 is slipped in the direction of S and ultimately removed from the resulting structural member 22. In this manner, the radially-directed pressure given by the Janssen relation remains substantially unchanged and smooth, that is not discontinuous, along the surface of the soil-retaining sheet.

A pillar 24 shown generally in FIG. 3 comprises a plurality of tubes 26 and 28 positioned substantially upright each tube 26 and 28 having a minor portion 30 and 32 respectively extending downward into the soil 34 and 36 respectively surrounding the lower ends of the tubes 26 and 28. A column of soil 38 is retained within the tubes 26 and 28. The two tubes 26 and 28 are positioned coaxially with respect to one another, the lower tube 28 having a greater cross-sectional area than that of the next adjacent upper tube 26 and made of a thicker material if necessary. The lower tube 28 can be joined to the upper tube 26 by means 40 for sealing the soil within the tube. The sealing means can be an adhesive tape, adhesively-bonded collar, or the like. A cap means 42 for containing the soil 38 within the tube acts to distribute any compression load placed on the top of the pillar 24 over substantially the entire top surface 44 of the column of soil 38.

Figure 5:
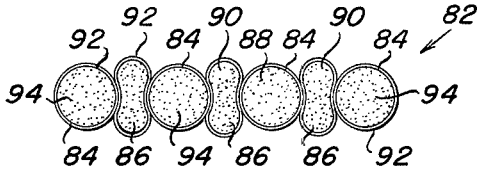
FIG. 5 is a plan view of a wall comprising a plurality of horizontally-adjacent pillars according to this invention wherein a first of the pillars has a substantially circular cross-section, each pillar immediately adjacent has a waisted cross-section, and each pillar immediately adjacent to a waisted cross-section column has a substantially circular cross-section.
Figure 6:
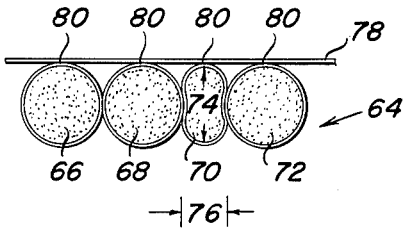
FIG. 6 is a plan view of a wall comprising a plurality of horizontally-adjacent pillars according to this invention each pillar abuting the adjacent pillar and including a substantially linear sheet fixed tangentially to the plurality of pillars.

A plurality of pillars according to this invention can be placed horizontally adjacent to form a wall as shown in FIGS. 4, 5 and 6. In FIG. 4, a plurality of horizontally-adjacent pillars 44, 46, and 48 have a substantially linear sheet 50 fixed tangentially to the plurality of pillars. The sheet 50 can be fixed to the pillars 44, 46, and 48 at tangent points 52, 54 and 56 respectively by any suitable adhesive-bonding substance placed between the sheet 50 and the pillars or by rivets, nuts and bolts, or any other known method. The sheet 50 together with the pillars form a wall 58 capable of controlling the ingress and egress of the natural environment. The pillars 44, 46 and 48 each comprise at least one tube 60 filled with soil indigenous to the region. The indigenous soil 62 does not include any cementitious or binding material other than that which would naturally occur in the soil of the region. The sheet 50 may be placed either on the interior or exterior of any structure defined by the wall 58. The pillars 44, 46 and 48 of a wall 58 are in a spaced, horizontally-adjacent relationship one to another.

Figure 7:
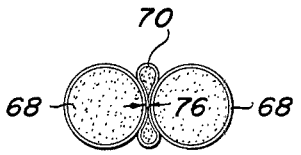
FIG. 7 is a plan view of a wall comprising a plurality of horizontally-adjacent pillars similar to that of FIG. 5 wherein the pillars having a waisted cross-section have a waist of negligible thickness and can be referred to as having a FIG. 8 cross-section.

In contrast, FIG. 6 shows a wall 64 in which the pillars 66, 68, 70 and 72 according to this invention are immediately adjacent to one another. While pillars 66, 68 and 72 are of substantially circular cross-section, pillar 70 is said to have a waisted cross-section characterized by one cross-sectional dimension 74 being greater than another cross-sectional dimension 76. In FIG. 7 the pillar 70 having the waisted cross-section has a negligible dimension 76 and can thus be thought of as a "figure eight" column. The wall 64 can include a substantially linear sheet 78 which can be fixed to the columns forming the wall at appropriate points 80.

The wall 82 shown in FIG. 5 is a structure of a particular strength and comprises a plurality of horizontally-adjacent pillars 84 having a substantially circular cross-section interspaced between and placed immediately adjacent to a plurality of pillars 86 having a waisted cross-section. The wall 82 therefore comprises a first pillar 88 having a substantially circular cross-section, each pillar 90 immediately adjacent to the first pillar 88 having a waisted cross-section, and each pillar immediately adjacent to any waisted cross-section column having a substantially circular cross-section. As before, the pillars 84 and 86 of wall 82 each comprise a tube 92 filled with soil 94 indigenous to the region. The tubes 92 of FIG. 5, like the tubes of FIGS. 3, 4 and 6, each comprise a soil-retaining sheet 10 as shown in FIG. 1 having the configuration as shown in FIG. 2.

FIG. 7 is a perspective view of a desert building 100 comprising a plurality of walls 102 and pillars 104 constructed according to this invention. Each wall 102 comprises a plurality of horizontally-adjacent pillars 104 and a substantially linear sheet 106 fixed to the pillars 104 in a fashion similar to that shown in FIG. 4. The linear sheet 106 is shown positioned on the inside of pillars 104 but could alternatively be positioned on the outside of the plurality of pillars.

Each of the pillars 104 comprises a plurality of tubes 108 positioned coaxially one above the other, each lower tube 110 having a cross-sectional area greater than each next adjacent upper tube 112. Each tube 108 is filled with soil 114 indigenous to the region and contains no binder or bonding agent except that which naturally occurs in the soil indigenous to the region. In a desert building 100 according to this invention the soil would most typically be sand.

Each tube 108 comprises a soil-retaining sheet as shown in FIG. 1. Each tube 108 is positioned in a substantially upright position such that a minor portion of the tube extends downward into the soil immediately surrounding the lower end of the tube as shown in FIG. 3. A roof structure 118 can be supported by the pillars 104 with or without the assistance of tension cables 120 in combination with sand bags 122 placed on top of the roof structure.

A desert building 100 has particular utility not only as a storage building or warehouse, but if the roof structure 118 and linear sheet 106 are made of a light-transmissive plastic, the structure can be used as a greenhouse. The plastic sheets forming the roof structure have little weight and as a result the distance between the pillars 104 can be rather large.

Figure 8:
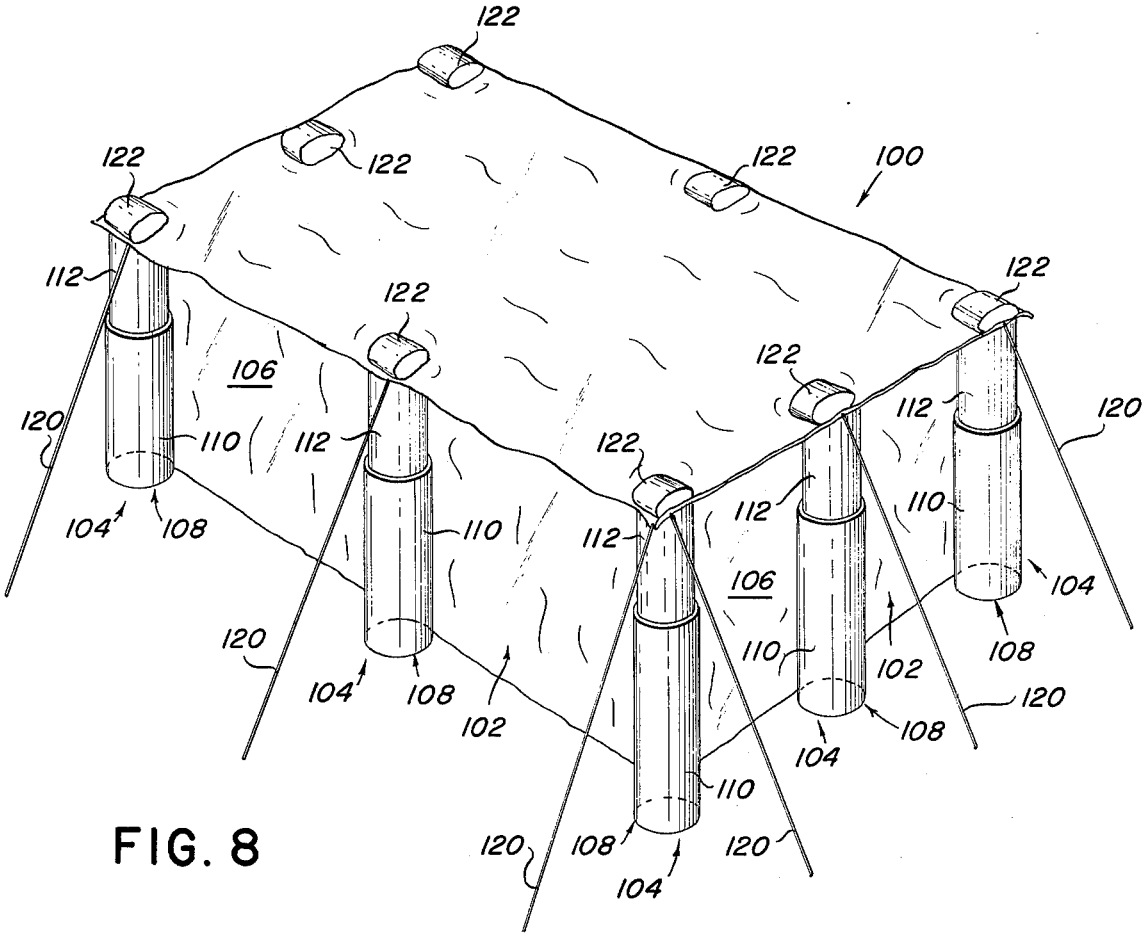
FIG. 8 is a perspective view of a desert building comprising a plurality of walls and pillars constructed according to this invention.

A desert building 100 of this type also has particularly noteworthy military uses. Not only are the walls and roof structure of the building supported by columns of soil indigenous to the area, but if the walls and roof are coated with an adhesive and brought in contact with a soil such as sand before being positioned on the structure, the building is effectively camouflaged. Further, if the walls of such a structure are formed as shown in FIGS. 5, 6, or 8, significant protection is afforded to personnel within the structure. With the use of motorized conveyor belts to handle the filling of the soil columns, whole tank corps could be effectively concealed in this manner in a matter of hours.

Although the invention has been described in considerable detail with reference to certain preferred embodiments thereof, it will be understood that variations and modifications can be effected within the spirit and scope of the invention as described above and as defined in the appended claims.

What is claimed is:

1. A structural member comprising at least one substantially smooth, linear tube, each tube comprising a material having sufficient tensile strength to retain a column of soil in pillar-like configuration, the tubular configuration having a waisted cross-section, each tube positioned substantially upright having an upper end and a lower end, a minor portion of each tube extending downward into the soil immediately surrounding the lower end of each tube, and a column of soil retained within each tube.

2. A structural member comprising at least two substantially smooth, linear tubes positioned horizontally adjacent, each tube comprising a material having sufficient tensile strength to retain a column of soil in pillar-like configuration, each tube positioned substantially upright having an upper end and a lower end, a minor portion of each tube extending downward into the soil immediately surrounding the lower end of each tube, each horizontally-adjacent tube has differing cross-sections, a first tube having a substantially circular cross-section, each tube immediately adjacent to the first tube having a waisted cross-section, and each tube immediately adjacent to any waisted cross-section tube, having a substantial circular cross-section and a column of soil retained within each tube.

3. A structural member comprising at least two substantially smooth, linear tubes positioned horizontally adjacent, each tube comprising a material having sufficient tensile strength to retain a column of soil in pillar-like configuration, each tube positioned substantially upright having an upper end and a lower end, a minor portion of each tube extending downward into the soil immediately surrounding the lower end of each tube each horizontally-adjacent tube further comprising a plurality of tubes positioned coxially one above the other, each lower tube having a cross-sectional area greater than each next adjacent upper tube, and a column of soil retained within each tube.

4. The structural member of claim 3 wherein each lower tube is joined to each next adjacent upper tube by means for sealing the soil within the tube.

5. The structural member of claim 3 wherein the upper end of each uppermost tube further comprises cap means for containing the soil within the tube.

6. A wall comprising a plurality of horizontally-adjacent pillars, each pillar comprising at least one substantially smooth, linear tube, each tube filled with soil, each tube made of a material having sufficient tensile strength to retain the soil in pillar-like configuration, each tube positioned substantially upright having an upper and a lower end, a minor portion of each tube extending downward into the soil immediately surrounding the lower end of the tube, a first of said horizontally-adjacent pillars having a substantially circular cross-section, each pillar immediately adjacent to the first pillar having a waisted cross-section, and each pillar immediately adjacent to any waisted cross-section pillar having a substantially circular cross-section.

7. A desert-building comprising a plurality of walls, each wall comprising a plurality of horizontally-adjacent pillars, each pillar comprising a plurality of substantially smooth, linear tubes positioned coaxially one above the other, each lower tube having a cross sectional area greater than each next adjacent upper tube, each tube filled with soil, each tube made of a material having sufficient tensile strength to retain the soil in pillar-like configuration, each tube positioned substantially upright having an upper and a lower end, a minor portion of each tube extending downward into the soil surrounding the lower end of each tube, a substantially linear sheet of material being fixed tangentially to a plurality of said horizontally-adjacent pillars.

8. The desert building of claim 7 further comprising a roof structure supported by the plurality of pillars.

9. The desert building of claim 8 wherein the roof structure is further supported by a plurality of tension cables and sand bags placed on top of the roof structure and the plurality of columns.

10. The desert building of claim 7 for use as a desert greenhouse comprising a roof structure of substantially transparent plastic sheets supported by the plurality of pillars, these sheets descending from the tops of the plurality of pillars on every side of the structure thereby creating an area completely enclosed by the plastic sheets preventing any escape of water except the minimal amounts transpiring through the plastic sheet.

* * * * *